US009068305B2

(12) United States Patent
Cardoso

(10) Patent No.: US 9,068,305 B2
(45) Date of Patent: Jun. 30, 2015

(54) SECTIONS OF TRAFFIC INFRASTRUCTURES INCLUDING MULTIPURPOSE STRUCTURES

(75) Inventor: Paulo Alexandre Teixeira e Silva Cardoso, Alameda dos Oceanops (PT)

(73) Assignee: Alva Alta AG, Chur (CH)

( * ) Notice: Subject to any disclaimer, the term of this patent is extended or adjusted under 35 U.S.C. 154(b) by 0 days.

(21) Appl. No.: 12/998,781

(22) PCT Filed: Nov. 23, 2009

(86) PCT No.: PCT/PT2009/000061

§ 371 (c)(1),
(2), (4) Date: Jun. 21, 2011

(87) PCT Pub. No.: WO2010/064942

PCT Pub. Date: Jun. 10, 2010

(65) Prior Publication Data

US 2011/0250015 A1 Oct. 13, 2011

(30) Foreign Application Priority Data

Dec. 1, 2008 (PT) ..... 104272

(51) Int. Cl.
*E01F 9/00* (2006.01)
*E01F 9/011* (2006.01)

(52) U.S. Cl.
CPC ..... *E01F 9/0113* (2013.01)

(58) Field of Classification Search
CPC ..... F21S 8/032; E01C 17/00; E01C 9/0113
USPC ..... 404/1, 6–16; 14/18, 77.1, 78; 136/245; 52/83; 362/157, 183, 431
See application file for complete search history.

(56) References Cited

U.S. PATENT DOCUMENTS

| | | | | | |
|---|---|---|---|---|---|
| 4,200,904 | A * | 4/1980 | Doan | 362/183 |
| 4,319,310 | A * | 3/1982 | Kingsley | 362/183 |
| 4,481,562 | A * | 11/1984 | Hickson | 362/183 |
| 4,718,185 | A * | 1/1988 | Conlin et al. | 40/442 |
| 5,107,637 | A * | 4/1992 | Robbins | 52/28 |
| 5,149,188 | A * | 9/1992 | Robbins | 362/183 |
| 5,171,088 | A * | 12/1992 | Tellier et al. | 362/428 |
| 5,184,502 | A * | 2/1993 | Adams et al. | 73/31.01 |
| 6,060,658 | A * | 5/2000 | Yoshida et al. | 136/243 |
| 6,107,941 | A * | 8/2000 | Jones | 340/915 |
| 6,109,754 | A * | 8/2000 | Steele | 359/522 |
| 6,141,750 | A * | 10/2000 | Micali | 713/168 |
| 6,942,361 | B1 * | 9/2005 | Kishimura et al. | 362/240 |
| 7,098,807 | B2 * | 8/2006 | Seguin et al. | 340/907 |
| 7,230,819 | B2 * | 6/2007 | Muchow et al. | 361/601 |
| 7,237,360 | B2 * | 7/2007 | Moncho et al. | 52/28 |
| 7,285,719 | B2 * | 10/2007 | Conger | 136/245 |

(Continued)

*Primary Examiner* — Raymond W Addie
(74) *Attorney, Agent, or Firm* — Southeast IP Group, LLC; Thomas L. Moses

(57) ABSTRACT

The present invention discloses sections of highway traffic infrastructures, including multipurpose structures, for best combining renewable energy and traffic assistance systems along the highway. According to a first innovative aspect, the distribution of structures accounts for aspects such as driving comfort, (urban) landscape integration and adjustment to energy demand and traffic circulation conditions. According to a complimentary innovative aspect, ample elevated constructions, as required by solar and wind energy systems, combine with certain dimensional dispositions, as required by different traffic assistance means, in view of enhanced energy distribution and traffic safety.

30 Claims, 10 Drawing Sheets

(56) References Cited

U.S. PATENT DOCUMENTS

| | | | | |
|---|---|---|---|---|
| 7,317,405 | B2 * | 1/2008 | Green et al. | 340/907 |
| 7,321,173 | B2 * | 1/2008 | Mann | 290/55 |
| D582,594 | S * | 12/2008 | Zhou et al. | D26/69 |
| 7,469,541 | B1 * | 12/2008 | Melton et al. | 60/641.1 |
| 7,471,213 | B2 * | 12/2008 | Ellison | 340/907 |
| 7,492,120 | B2 * | 2/2009 | Benn et al. | 320/101 |
| 7,646,621 | B2 * | 1/2010 | Kent | 363/147 |
| 7,731,383 | B2 * | 6/2010 | Myer | 362/145 |
| D622,887 | S * | 8/2010 | Lewis | D26/71 |
| 7,800,515 | B2 * | 9/2010 | Chen | 340/907 |
| 7,888,590 | B2 * | 2/2011 | Niederer | 136/251 |
| 7,912,590 | B2 * | 3/2011 | Wilkes | 700/291 |
| 7,987,641 | B2 * | 8/2011 | Cinnamon | 52/173.3 |
| 7,988,320 | B2 * | 8/2011 | Brumels | 362/192 |
| 8,007,124 | B2 * | 8/2011 | Kim | 362/158 |
| 8,487,469 | B2 * | 7/2013 | Christy et al. | 290/55 |
| 8,505,248 | B1 * | 8/2013 | Leong et al. | 52/173.3 |
| 2002/0175831 | A1 * | 11/2002 | Bergan et al. | 340/908.1 |
| 2005/0102872 | A1 * | 5/2005 | Seguin et al. | 40/601 |
| 2008/0150290 | A1 * | 6/2008 | Fein et al. | 290/55 |
| 2008/0150296 | A1 * | 6/2008 | Fein et al. | 290/1 R |
| 2008/0196758 | A1 * | 8/2008 | McGuire | 136/245 |
| 2008/0217998 | A1 * | 9/2008 | Parmley | 307/65 |
| 2008/0278934 | A1 * | 11/2008 | Maldonado | 362/183 |
| 2008/0308091 | A1 * | 12/2008 | Corio | 126/606 |
| 2009/0050194 | A1 * | 2/2009 | Noble et al. | 136/251 |
| 2009/0145423 | A1 * | 6/2009 | Carcangiu et al. | 126/600 |
| 2009/0232596 | A1 * | 9/2009 | Groot | 404/9 |
| 2009/0237918 | A1 * | 9/2009 | Yang | 362/183 |
| 2009/0273922 | A1 * | 11/2009 | Ho et al. | 362/183 |
| 2010/0230975 | A1 * | 9/2010 | Schmitt et al. | 290/55 |
| 2011/0107684 | A1 * | 5/2011 | Flores | 52/29 |
| 2011/0277809 | A1 * | 11/2011 | Dalland et al. | 136/244 |

* cited by examiner

SECTIONS OF TRAFFIC INFRASTRUCTURES INCLUDING MULTIPURPOSE STRUCTURES

CROSS-REFERENCE TO RELATED APPLICATION

This application claims priority from International Application PCT/PT2009/000061, filed Nov. 23, 2009, and Portuguese Application No. 10472 filed Dec. 1, 2008.

BACKGROUND OF THE INVENTION

The present invention relates to sections of highway traffic infrastructures, including structures carrying solar energy (SE) systems, eventually also other renewable energy systems (RES), automatic signaling and/or lighting systems, and, eventually, other traffic assistance systems (TAS).

Installing RES along traffic infra-structures presents important benefits, especially in areas of high population densities. On the one hand, integration of RES into urban settings is important in view of inherent proximity to high energy demand density areas, and traffic infra-structures represent significant areas with solar exposure. On the other hand, many traffic accidents result from deficient signaling or visibility conditions, in particular as related to static conditions such as certain topographic and infrastructure design features, or to dynamic conditions such as hazardous weather, traffic flow intensity, and accidents along a traffic way.

There have been many suggestions of installing RES, in particular photovoltaic (PV) devices or arrays along roads, mostly using dividing barriers and sound barriers—see EP 0 774 168 B1—, and tunnel or tunnel-like structures—see DE 101 25 147 A1, DE 203 17 683 U1—and over circulation lanes—see DE 44 17 065 A1, DE 44 31 154 C3.

The DE 3412584 A1 discloses a T-shape structure carrying solar energy panels, and also general lighting and traffic surveillance means, approximately in a common plane at an elevated level over a highway. The fundamental aspect of this design is its continuous, regular repetition over very substantial highway lengths. While maximizing PV area per kilometer, it presents major disadvantages. In terms of driving comfort, it substantially obstructs the upper view field of drivers over substantial lengths, producing monotonic shades, with accentuated light/dark contrast areas, eventually leading to visual discomfort. In terms of driving safety, the ever regular repetition of vertical trusses does not communicate varying road conditions, such as curves, slopes, injunctions, or recommended driving speed, eventually leading to fatigue and inattention. In terms of integration into local (urban) landscape, its constant shape and size eliminates diversity opportunities along several road sections in a given region thereby assisting orientation across it. Because of its "great wall" nature, such a continuous built volume is of reduced applicability to urban settings. Its central positioning is not adequate to certain traffic infrastructure typologies. Moreover, this design does not include lighting and/or traffic monitoring means at a road circulation level (e.g., in the supporting beams) nor does it disclose their variable distribution according to locations of varying requirements along a longer extension of a traffic way (reduced applicability to highway settings). Therefore, these traffic-aid structures do not address respective impacts upon driving comfort and upon local (urban) landscape—two factors fundamentally determining their benefits and potential. In fact, for structures of such dimensions, extending over substantial lengths, respective design and distribution along a traffic infrastructure is a crucial aspect determining driving comfort, passive and active traffic safety possibilities, and better integration into a given road typology and respective urban surroundings, while further ensuring the benefits from combining renewable energy and traffic assistance means along such traffic infrastructures.

None of the aforementioned documents discloses a solution in consideration of the aforementioned design aspects, to refurbish substantial lengths of traffic infrastructures with such structures.

SUMMARY OF THE INVENTION

The goal of the present invention is to provide sections of traffic infrastructures, including certain locations and distributions of structures best combining renewable energy systems, and traffic assistance systems, over substantial lengths of traffic infrastructures. This need be done in such a way that they effectively address both the functional, including driving comfort, integration into local (urban) landscape; and operational requisites including energy and information generation, distribution and use in a cost effective manner.

Such a goal requires an efficient configuration and distribution of such structures and technical means along a section of traffic infrastructure, in view of such diverse issues as:

a) driving comfort, e.g., by minimizing reductions of the vision field within and beyond the traffic way and avoiding extensive repetition of strong contrast light/shade patterns, and integration into the local (urban) landscape, e.g., by avoiding sprawling of vertical light structures ("street lamps effect") and massive spatial obstructions from horizontal constructions (resulting from a continuous "dividing wall");

b) construction flexibility in view of design of traffic infrastructures, different typologies, e.g., intercity road, metropolitan highway, circulation conditions, e.g., exit ways, crossings, and topographic conditions, e.g., curves, slopes, and of energy and information generation, distribution and use. For example, adjusting power delivery points to available proximity demand and traffic flow monitoring means to potential hazard zones, while keeping a common underlying metric, as required by effective passive and active traffic assistance means;

c) enhanced traffic safety, by avoiding constraints of tunnel-like constructions, and by adding signaling/lighting means disposed in certain patterns, especially effective at roadside and traffic overhanging levels, and automatic short-range monitoring and communication means for real time notification of downstream traffic hazards.

The aforementioned goal is attained according to the present invention by means of a section of traffic infrastructure, including structures according to claim 1.

The structures according to the present invention present a design avoiding "streetlamp" and "tunneling" effects, with two basically distinct levels for renewable energy systems (solar and wind) and two levels for traffic assistance systems. This ensures best spatial distribution of renewable energy systems and traffic assistance systems in view of respective efficiencies. Moreover, these structures are distributed in certain patterns of similar and/or varying length and/or distances in between, thereby being adjustable to different driving experience settings and road conditions in a given section, or different roads in a given region, while keeping a common denominator metric, allowing adjustment of respective traffic assistance means to varying road conditions. Such structures also provide support for enhanced traffic assistance means, not only by including automatic data, preferably short-range, collection and communication, processing and display means, but also by optimizing the location of signaling and lighting means at different levels and intervals according to the distribution of the structures over a given extension.

Other advantageous embodiments of the sections of traffic infrastructure, including multipurpose structures according to the present invention result from the secondary claims.

Besides the above characteristics, the present invention proposes certain preferred embodiments of multipurpose structures installed in sections according to the present invention.

According to one such characteristic, the multipurpose structures present side elements designed as a single-piece, or present several individual construction elements.

According to another characteristic, the side elements have a solid cross-section, more preferably, a hollow cross-section, as an open profile of U shape, I shape, X shape, H shape, L shape or similar, preferably cable-like, chain-like, tube-like, beam-like, frame-like. Moreover, according to another characteristic, the side elements are made of any usual construction materials such as concrete compositions or similar, steel or steel alloy, other metals and metallic alloys, wood or wood laminates, synthetic materials such as polymer composites, carbon fiber, composite materials, materials with special micro- or nano-structures, or any other having similar or higher structural resistance, durability and longevity parameters. According to another characteristic, the side elements are substantially opaque, light reflecting or translucent. According to another characteristic, at least some the side elements include or may be fitted with a stairs device, and respective security access means for an authorized person to access the, at least one, top element.

According to another characteristic, at least some of the side elements individually or jointly carry at least one lighting array, preferably disposed at least at a traffic circulation level and substantially oriented towards a respective circulation area of traffic infrastructure (A).

Moreover, the present invention proposes certain characteristics for the top elements of the multipurpose structures in a section according to the present invention.

According to one characteristic, at least some of the side elements support a wind energy array.

According to another characteristic, at least some of the side elements include at least one weather condition array and/or at least one traffic flow array, preferably disposed at a traffic circulation level.

According to another characteristic, the top elements have a length (d) in the range of about 4-40 m, preferably 5-20 m, more preferably 6-10 m, and a width (e) in the range of about 1-4 m, preferably 1-3 m, more preferably 1-2 m, and that these dimensions are preferably much bigger than its height. According to another characteristic, the length (d) is a multiple of the width (e), and the latter is preferably a divisor or multiple of the distance (c).

According to another characteristic, the top elements are substantially flat and rigid, such as plate-like, or flexible, such as membrane-like or fabric-like. The elements are made of one piece, or of several, preferably similar, individual pieces, eventually provided with interlocking means along at least one side, preferably all sides thereof. According to another characteristic, the top elements have a substantially rectangular, or L shape, or C shape, or I shape, and cable-like, chain-like, tube-like, beam-like, frame-like or similar format, a perforated or continuous surface, or any other shape, format and surface finishing, and a substantially linear or curved extension along at least one of its two bigger dimensions.

According to another characteristic, at least some of the top elements are collectively or individually mounted, so as to be pivotally rotated, preferably by means of automatically controlled driving means, around a longitudinal axis thereof. According to another aspect, at least one of the top elements corresponds to, or has installed thereupon in a removable fashion, at least one walkway element, preferably provided with respective safeguard. This allows safe access by at least one person to each PV array installed in the top element. According to another characteristic, at least some of the top elements include at least one array support with pivotal bearings that carry a support shaft preferably disposed along the length (d) and allowing it to be rotated by at least 90° in both directions, preferably by 180° in both directions, more preferably by 360° in one direction. According to another characteristic, the support shaft includes individual supports for each PV device which include a rotating support that allows rotating each respective PV device by at least 90° in both directions along a plane that is orthogonal to that of the pivotal bearings. According to another characteristic, at least one of the top elements directly or indirectly supports, suspends or is made integral with at least one lighting array on the inferior side, facing traffic infrastructure (A). According to another characteristic, at least one of the top elements directly or indirectly supports, suspends or itself integrates at least one traffic flow array, preferably disposed on the interior side, vertically aligned with a respective circulation lane of traffic infrastructure (A).

According to another characteristic, the top elements are made of light materials, such as metals or special light metal alloys, wood or wood laminates, synthetic materials such as polymer composites, carbon fiber, composite materials, materials with special micro- or nano-structures, specially engineered membranes and fabrics, or any other material presenting similar or higher structural resistance to weight ratios, durability and longevity parameters. According to another characteristic, the top elements are substantially opaque, preferably translucent and/or its upper surface has a light color or light reflecting finishing. According to another characteristic, the top elements are substantially pre-assembled in a remote location and assembled together on location. According to another characteristic, at least one of the top elements carries at least one weather condition array.

Moreover, the present invention proposes certain characteristics associated with the solar energy and lighting devices installed in a section according to the present invention.

According to one characteristic, at least one PV array comprises a PV device of any format, shape, dimensions or photovoltaic technology. According to another characteristic, each PV array presents a row-like arrangement, disposed substantially along the longitudinal (x) or the cross direction (y) of traffic infrastructure (A). According to another characteristic, each PV array is disposed at a fixed tilt and orientation, preferably includes single-axis, more preferably double-axis Sun tracking means, preferably automatically controlled and preferably mechanically driven. According to another characteristic, the PV arrays on a structure, preferably on several structures, are individually, preferably jointly, controlled by a dedicated control system including at least one programmable automatic control device and preferably a wireless communication device.

According to another characteristic, the lighting devices are based on LED technology, or analogous technology of similar or higher energy efficiency. According to another characteristic, the lighting arrays disposed in side elements and/or in top elements present a configuration in each case similar, preferably different. According to another characteristic, the lighting arrays disposed in side elements and/or in top elements operate in each case in the same or different lighting and/or signaling modes, thereby generating lighting of similar or preferably different, color and/or intensity, and/or at similar or preferably different frequencies, and/or on/off time sequences. According to another characteristic, the lighting arrays present a substantially rectangular or circular format, and a preferably flat construction. According to another characteristic, each of the lighting arrays, and/or each disposition level thereof, is directly controlled by a dedicated control system that includes a, programmable, automatic control device and a, preferably wireless, communication device.

Moreover, the present invention proposes certain characteristics associated with additional energy and information systems implemented in a section of traffic infrastructure according to the invention.

According to one characteristic, at least one wind energy array includes at least one, preferably several, wind energy devices, preferably based on vertical axis wind turbine technology and installed upon a common rotating shaft, whereby the latter is connected to a respective array power alternator. According to another characteristic, the wind energy arrays on a structure, preferably on several structures, are individually, preferably jointly controlled by a dedicated control system that includes at least one, preferably programmable, automatic control device and a, preferably wireless, communication device.

According to another characteristic, at least one weather condition array includes at least one sensor for at least one parameter relating to prevailing weather conditions, such as dry-bulb air temperature, relative humidity, solar radiation components, wind speed, rain or snow precipitation conditions, and at least one, preferably wireless, communication device.

According to another characteristic, the traffic flow array includes at least one device for remote determination of at least one parameter relating to traffic flow conditions, such as the number, type, circulating speed and/or flow rate of vehicles circulating in individual or groups of lanes within each traffic direction of traffic infrastructure (A), and at least one, preferably wireless, communication device.

According to another characteristic, at least one power storage array, including at least one power storage device, is associated with each the structure, or group thereof.

According to another characteristic, at least part of the total power generated in each structure is supplied to a power grid by means of power lines disposed along one (a1), and/or both sideways (a2), and/or traffic dividing areas (a3, . . . ) of traffic infrastructure (A).

Moreover, the present invention further proposes certain characteristics of the method for managing the operation of at least one section (b1) of a traffic infrastructure (A), according to the present invention.

According to a first characteristic, it is a method comprising one process (E) for optimizing the power generation, handling and distribution conditions along each highway section (b1, . . . ), and/or one process (T) for optimizing the active traffic assistance conditions along each section (b1, . . . ), characterized in that each process (E, T) is carried out by, preferably programmable, automatic monitoring and control means specific to one or more sets of lighting arrays, PV arrays, wind energy arrays, weather condition arrays, traffic flow arrays, and/or at least one power delivery station of a local control station and/or remote station.

According to another characteristic, as part of the process (E), each PV array, wind energy array, or preferably a respective group thereof, is controlled by respective control means, wirelessly power delivery station, a local control station, and/or by a remote station.

According to another characteristic, as part of the process (T), each lighting array, preferably a respective group thereof, is controlled by respective control means through a, preferably wireless, respective local control station, and/or by a remote station.

According to another characteristic, each of the processes (E, T) includes other relevant monitoring sources, such as power grid management systems (E), regional weather (E, T) and traffic monitoring (T) and vehicle communication systems (T).

According to another characteristic, the process (E) includes a function of the local time of the day and day of the year, a periodical condition assessment, and/or value measurement of a pre-defined set of weather and power generation, handling and distribution related parameters. The process includes assessment of variables, evaluation of the conditions and/or values, as referred to the PV arrays, wind energy arrays installed in a respective structures, and/or to respective power delivery stations, and control of respective operation accordingly.

According to another characteristic, the process (T) includes a function of the local time of the day and day of the year, a periodical condition assessment and/or value measurement of a pre-defined set of weather, traffic flow and lighting operation related parameters, and/or variables, evaluation of the conditions and/or values in respective discrete locations as referred to the lighting arrays along section (b1), and control of the respective operation accordingly.

According to another characteristic, as part of the process (E), each power delivery station monitors and controls power generation, power voltage variation and/or power storage by at least one structure, and monitors power delivery conditions on a respective location within the section (b1) to users, such as power transmission grid lines, lighting arrays and circulating vehicles.

According to another characteristic, as part of the process (T), the weather condition arrays and traffic flow arrays, periodically assesses the condition and/or measure the value of a set of respective pre-defined parameters at their respective location along (b1). At least under certain pre-defined conditions thereof, the conditions or values are communicated, preferably wirelessly, to the lighting arrays, and/or to a local control station, or remote station.

According to another characteristic, as part of the process (T), a pre-defined code of colors, emitting intensity, lighting frequency, and/or on/off time sequencing the lighting arrays, along section (b1) is associated with certain pre-parameterized conditions as monitored by a weather condition array and/or by a traffic flow array.

According to another characteristic, as part of at least one process (E, T), each local control station continuously monitors and controls the operation of the lighting arrays, PV arrays, wind energy arrays, weather condition arrays, traffic flow arrays, and/or power delivery stations, installed along the section (b1). Under certain conditions, the control means periodically communicates, preferably wirelessly, respective data to a remote station and/or to an adjacent control station.

According to another characteristic, as part of process (T), the remote station evaluates data as communicated by the weather condition arrays, traffic flow arrays, local control stations, and/or by external sources. In certain cases, the station communicates a certain condition to the lighting arrays installed in a specific structure or road-side element, to a pre-defined number of lighting arrays located directly upstream, and/or to at least one local control station directly upstream along the same traffic circulation direction.

According to another characteristic, as part of process (T), the remote station may bi-directionally communicate periodic updated weather conditions, and/or traffic flow information, preferably wirelessly, to information display arrays installed along a respective section (b1) and/or information display devices on board of vehicles circulating within or in the proximity of the section (b1) of traffic infrastructure (A).

According to another characteristic, the remote station continuously monitors, evaluates and controls relevant functions of process (E) and/or process (T) along each section (b1), preferably along several such sections (b1, . . . ), in at least one traffic infrastructure (A).

DESCRIPTION OF THE DRAWINGS

The present invention shall now be explained in more detail by reference to several preferred embodiments thereof, schematically represented in the drawings.

DESCRIPTION OF A PREFERRED EMBODIMENT

Figure 1A:
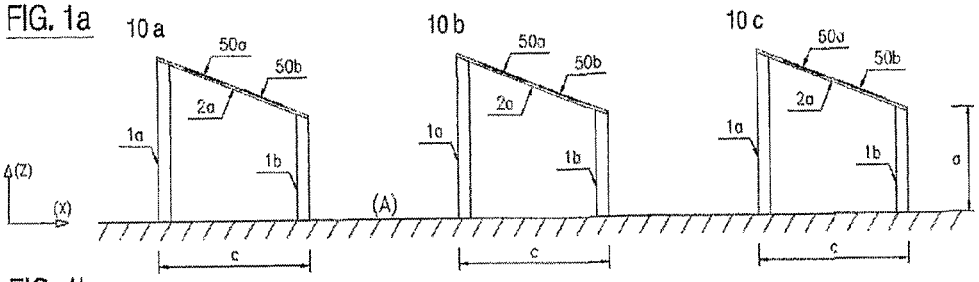
FIGS. 1*a*-1*e* illustrate a first preferred embodiment of multipurpose structures according to the present invention.
Figure 1B:
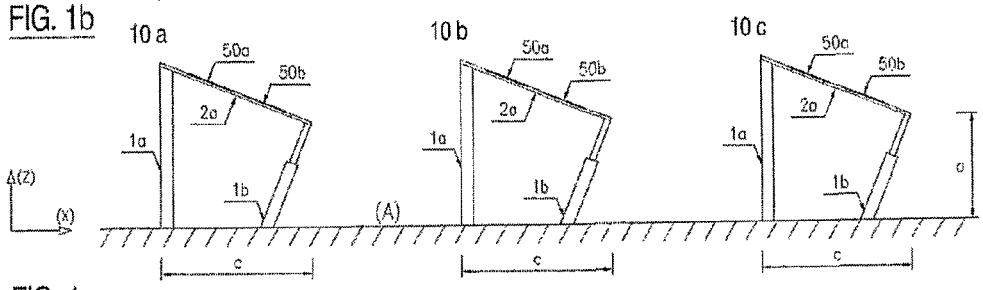

FIGS. 1*a* and 1*b* illustrate side views of three structures (10*a*, 10*b*, 10*c*) disposed along a traffic infrastructure (A). Successive side supports (1*a*, 1*b*) are disposed at a preferably regular length (c) from each other, reduced when compared to the total length of section (b1), preferably corresponding to the total length (f) of each structure (see FIGS. 3*a* and 3*b*). Both side elements (1*a*, 1*b*) support a top element (2*a*) at a height (a) above traffic infrastructure (A) have similar cross-section and different heights (FIG. 1*a*). Alternatively, both (1*a*, 1*b*) also have similar height and are provided with means allowing regulating different heights (a) or inclinations. This may be accomplished by means of a telescopic arm (3*a*) (FIG. 1*b*) that varies the total height of one side element (1*b*), or both (not represented), so that a certain tilt of the top element (2*a*) may be adjusted in relation to the longitudinal (x), or cross direction (y) of traffic infrastructure (A). Another option would be of using a sliding device (4*a*) in both side elements (FIG. 1*c*).

Figure 1C:
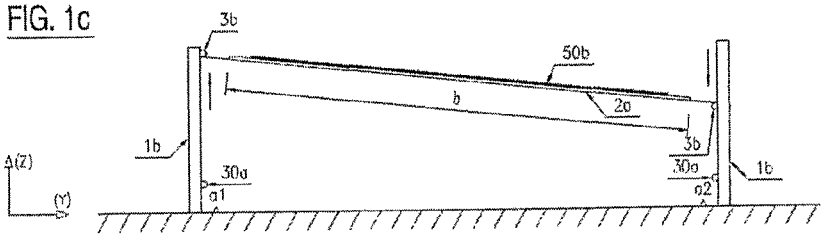
Figure 1D:
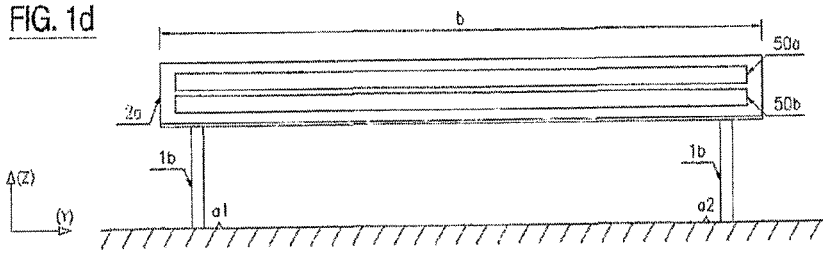
Figure 1E:
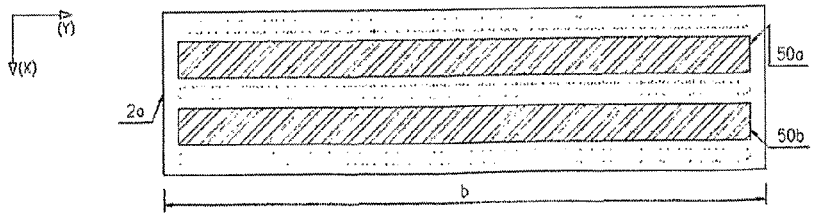

FIGS. 1*c* and 1*d* show front views along the cross-direction (y) of traffic infrastructure (A). Both side elements (1*a*, 1*b*) carry one elongated lighting array (30*a*) disposed approximately at traffic circulation level, oriented towards traffic infrastructure (A) and working as active signaling notably during night time. Both (1*a*, 1*b*) jointly tension one flexible, substantially translucent top element (2*a*), e.g., fabric, or membrane-like, whereupon two rows of PV arrays (50*a*, 50*b*) of a thin, flexible material have been attached or embedded (FIG. 1*e*). Alternatively, the side elements support (FIG. 1*d*) a rigid, plate-like top element (2*a*), whereupon there are, for example, two flat PV arrays (50*a*, 50*b*).

FIG. 1*e* is a plan view of a top element (2*a*) presenting certain open areas (represented in closed dotted lines), eventually of irregular dimensions and format, to reduce wind loads and projection of extensive, monotonic dark shade areas.

Figure 2:
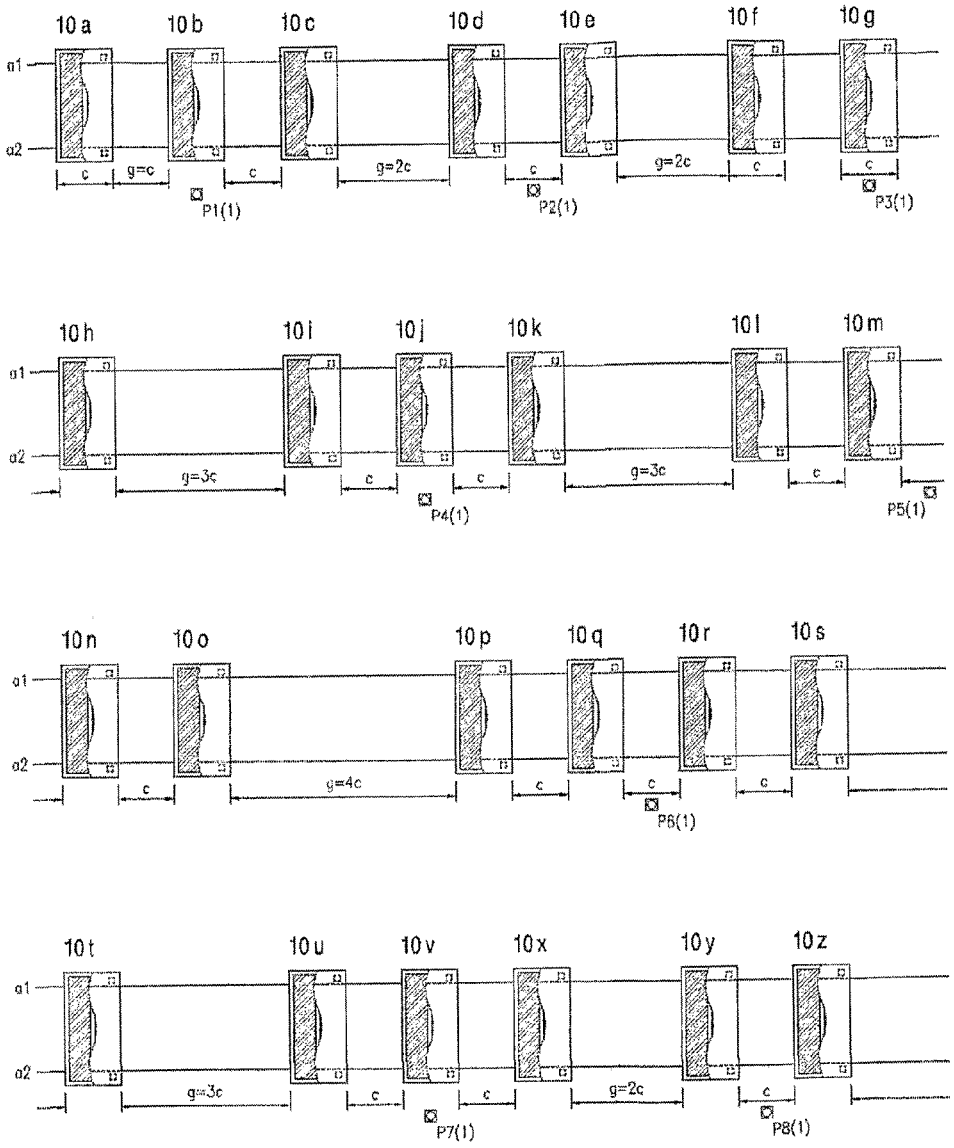
FIG. 2 illustrates a first example of a section of traffic infrastructure according to the present invention with structures according to FIG. 1, and respective management method.

FIG. 2 represents a first embodiment of a section (b1) of a traffic infrastructure (A) including structures (10*a*, 10*b*) according to their first embodiment (FIGS. 1*a*-1*e*). In this example, each structure (10*a*, 10*b*) is disposed at a, preferably constant, spacing (g) apart corresponding to the length (c) between successive side elements (1*a*, 1*b*), or to a multiple thereof (n×c). This spaced arrangement ensures that no top element projects a shade upon an adjacent one. Moreover, such spacing (g) is selected as a function of reference traffic conditions, such as, for example, maximum driving speed, or general visibility ahead, as these unfold along (x). Increasing spacing (g) reflects zones of increased maximum circulation speed (between 10*g* and 10*t*), and vice-versa.

The distribution of signaling/lighting arrays (30*a*, 30*b*) at traffic circulation level is used as part of the traffic infrastructures to actively signal the overall contour of traffic infrastructure (A) along section (b1), especially in areas requiring higher attention, such as smaller radius curves and steep slopes. The active signaling arrays (30*a*, 30*b*) are designed accordingly.

Regarding the renewable energy systems, relevant power handling, monitoring and control devices are housed in power delivery stations Pn(1) represented by squares with circles inside. These interface the PV arrays (50*a*, 50*b*) in each structure (10*a*, 10*b*) with a respective power distribution grid. Each set of 2 or 3 neighboring structures has a respective power delivery station Pn(1) disposed along one sideway (a1) of section (b1). In this case, there is no local power storage. All power generated by each structure (10*a*, 10*b*) is delivered to a power distribution grid.

Regarding a management method, there is only one, fully decentralized level, whereby each renewable energy system and traffic assistance system automatically controls itself based on pre-programmed time and calendar settings. Important control objectives are the maximization of power generation, by means of tilting the top elements accordingly, and the optimization of road-side active signaling functions provided by structures (10*a*, 10*b*), actuated during periods of reduced visibility.

FIGS. 3*a*-3*e* are schematic representations of a second embodiment of structures (10*a*, 10*b*) according to the invention.

Figure 3A:
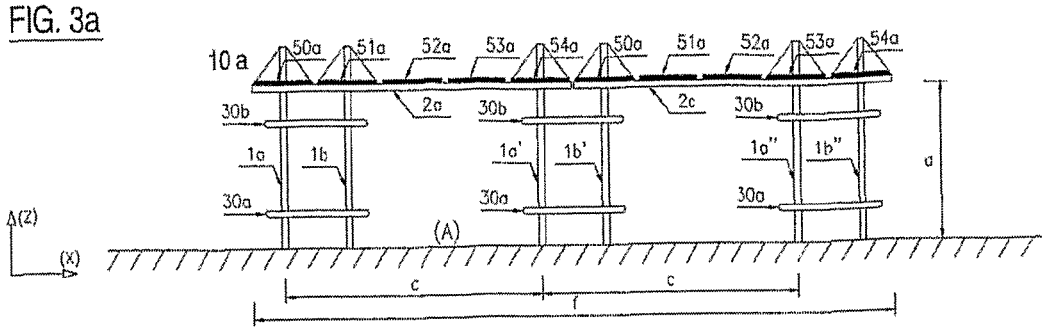
FIGS. 3*a*-3*d* illustrate a second preferred embodiment of multipurpose structures according to the present invention.
Figure 3B:
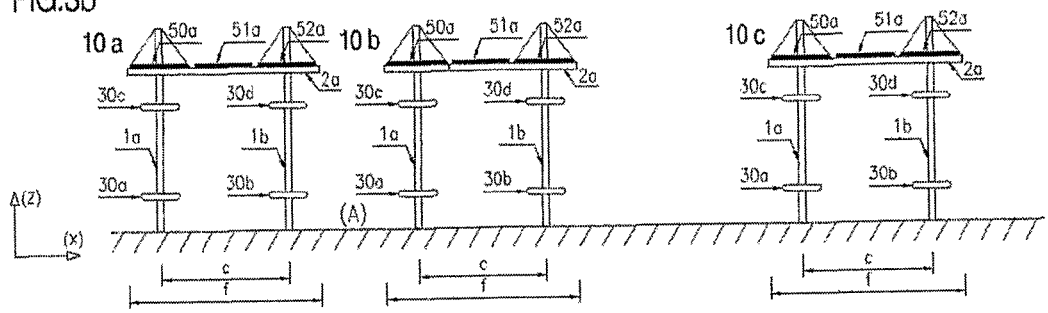

FIG. 3*a* shows a side view of a structure (10*a*) including three pairs of side elements (1*a*, 1*b*, 1*a*', 1*b*', 1*a*", 1*b*") of similar configuration. These are placed at a very close distance from each other, and each pair (1*a*, 1*b*) is spaced by a preferably constant, length (c) apart from the next one (1*a*', 1b'). Alternatively, such distance (c) could vary, preferably linearly or exponentially. Both (10*a*, 10*b*) carry horizontally elongated lighting arrays (30*a*, 30*b*) at two substantially different heights, and support and suspend two top elements (2*a*, 2*b*) from each side (FIG. 3*d*). FIG. 3*b* shows a side view of a similar structure (10*a*, 10*b*, 10*c*) presenting only one pair of side elements (1*a*, 1*b*) spaced apart by a distance (c), both suspending one top element (2*a*). The lower lighting arrays (30*a*, 30*b*) work as active signaling and the higher (30*c*, 30*d*) as active lighting, thus maximizing respective efficiency.

Figure 3C:
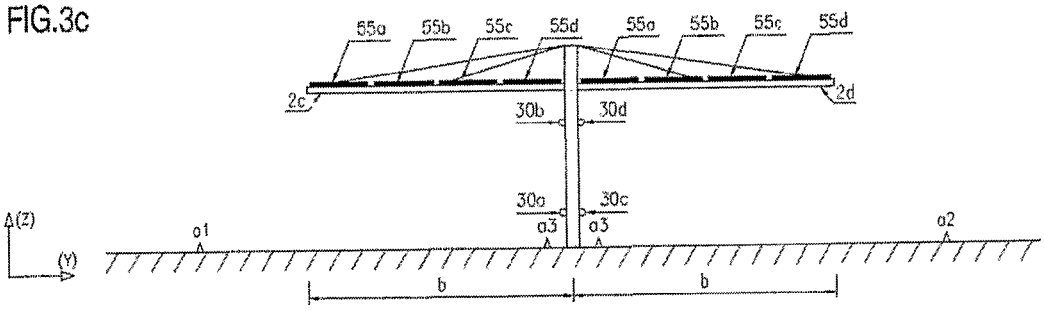
Figure 3D:
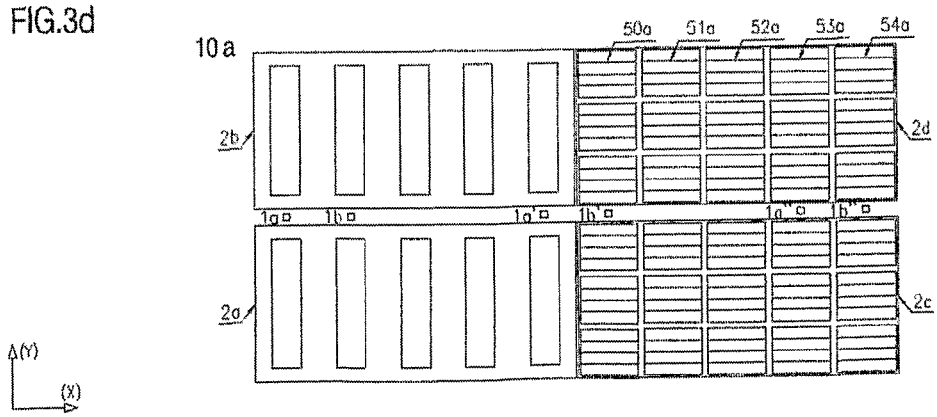

In the disposition shown in FIG. 3*c*, there is at least one very thin, plate-like, top element (2*a*, 2*b*) suspended from each side, manufactured in a single piece of flat, substantially rigid material having certain areas open, corresponding to the vertical projection of PV modules of a PV array (50*a*, 51*a*). Such top elements (2*a*, 2*b*) thus present a very low weight to area ratio (kg/m$^2$).

FIG. 3*d* shows a plan view upon the structure of FIG. 3*a*, allowing to recognize the individual overtures in some side elements (2*a*, 2*b*), and the distribution of PV arrays (50*a*, . . . ) upon other (2*c*, 2*d*). PV arrays (50*a*, . . . ) are based on PV technology that is substantially independent of its Sun orientation, and pre-assembled for installation on site. This overall configuration allows increasing the area available for PV arrays, while reducing production and installations costs of the respective structures.

Figure 4:
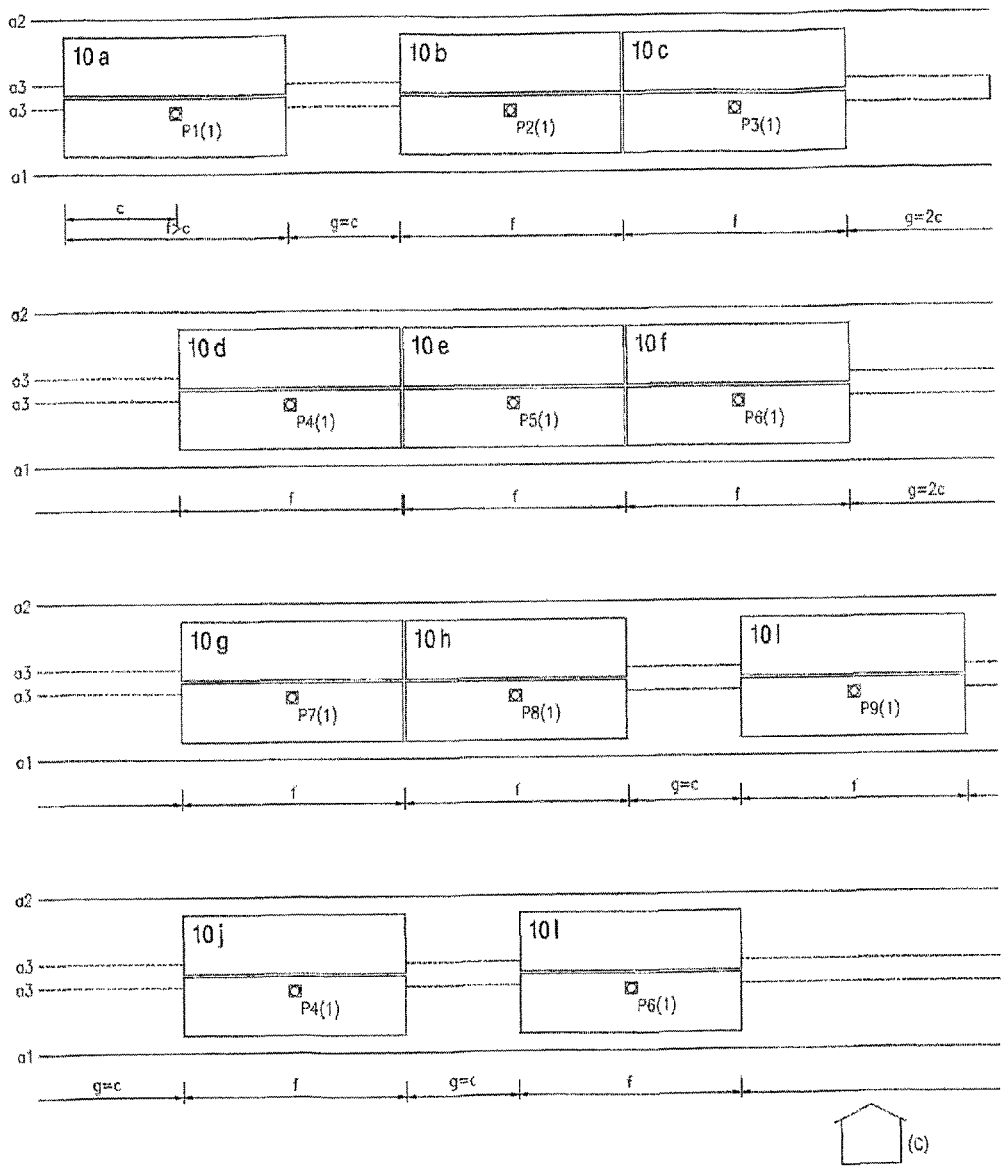
FIG. 4 illustrates a second example of a section of traffic infrastructure according to the present invention with structures according to FIG. 3, and respective management method.

FIG. 4 shows a second embodiment of a traffic section (b1) according to the present invention, with structures (10*a*, 10*b*) according to FIGS. 3*a*, 3*c*, 3*d*.

Given their configuration, several such individual structures (10*a*, 10*b*) may be placed directly next to each other (e.g., 10*b* and 10*c*, or 10*d*, 10*e* and 10*f*), adding to a total length (f) preferably not exceeding about 100 m. Their distribution follows a substantially random pattern along section (b1), this way compensating for a more intensive use with the avoidance of lengthy repeating, driving fatigue inducing regular patterns, and making it possible to adjust to elevated passageways, exits or crossings of the traffic infrastructure (A), while further having the distance (c), or multiples thereof, as a common denominator.

In terms of traffic assistance systems, given that some of the lighting arrays (30*a*) have an active signaling function, whereas others (30*b*) have a lighting function, a more intensive distribution of structures (10*a*, 10*b*) thus allows a more continuous use of the active signaling and lighting functions along this section (b1).

Each structure (10*a*, 10*b*) is associated with a respective power delivery station Pn(1), identified by a box with a circle inside, that regulates power delivery to, and eventually also from, a power grid. Each Pn is installed preferably at terrain level, alternatively a sub-terrain level, along the dividing area (a3) and may include power storage arrays and other power voltage handling devices, allowing for storing part of the generated power locally. The power is for later use by the renewable energy system or the traffic assistance system. Each station Pn may be connected to other energy generation systems, such as geothermal, and distribution and use systems, such as vehicle driving devices.

Regarding the management method, monitoring and control are carried out at two levels: the operation of all PV (50*a*, 51*a*) and lighting arrays (30*a*, 40*a*) in each multipurpose structure (10*a*, 10*b*) along section (b1). Monitoring and control is controlled by respective, system specific control means (Sn), and is supervised by a remote central station (C) (see also FIG. 9) or, alternatively, a local control station (Ln).

Figure 5A:
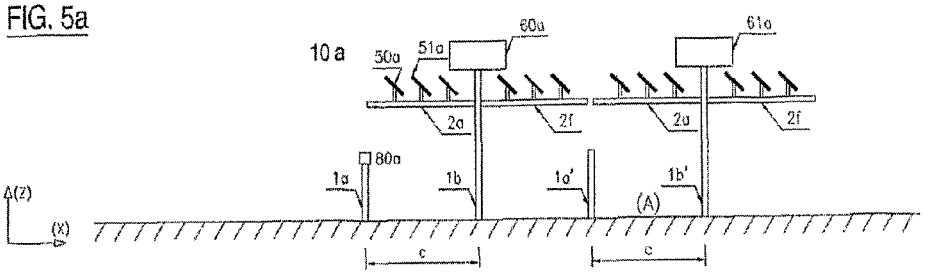
FIGS. 5*a*-5*f* Illustrate a third preferred embodiment of multipurpose structures according to the present invention.

FIG. 5*a* shows a side view of a third embodiment of a multifunctional structure (10*a*) according to the invention, with pairs of side elements (1*a*, 1*b*) of different cross-sections, heights and functions. Side elements (1*a*) carry at least one lighting array (30*a*) and a traffic flow array (80*a*), whereas side elements (1*b*) support several frame-like top elements (2*a*, 2*b*). There are several PV arrays (50*a*, 50*b*) disposed in rows upon the top elements (2*a*, 2*b*) and at least one wind energy array (60*a*, 60*b*, 60*c* and 61*a*, 61*b*, 61*c*) disposed at a higher level on some side elements (1*b*). Again, successive side elements (1*a*, 1*b*) are disposed preferably at a constant distance (c) apart along (x). Alternatively, the distance (c) varies, at least approximately, in a linear or exponential way.

Figure 5B:
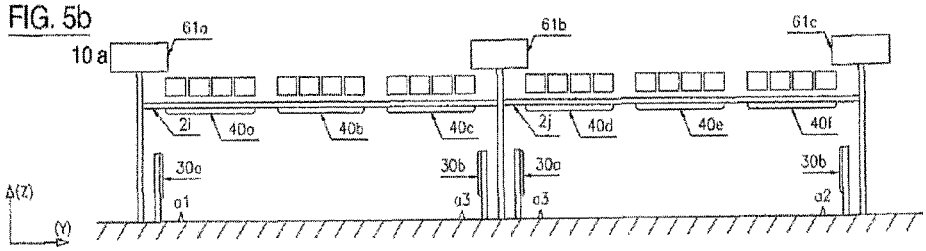

The front view in FIG. 5*b* shows that some side elements (1*a*) are disposed in directly opposing pairs in the sideways (a1, a2), while side elements (1*b*) are placed in sets of three along the sideways (a1, a2) and central dividing zone (a3). A weather condition array (70*a*) is placed on one of the side elements (1*b*) and/or in one of the top elements (2*a*, . . . ). There are also lighting arrays (40*a*, 40*b*) that in this case may be general lighting devices and/or hologram projection devices disposed directly above each circulation lane.

Figure 5C:
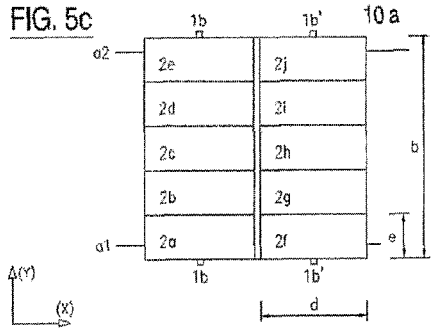
Figure 5D:
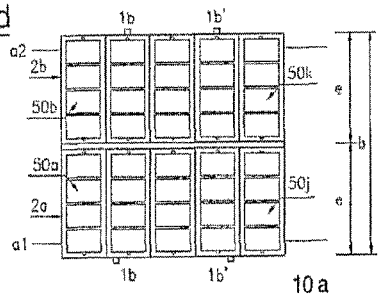

FIGS. 5*c* and 5*d* show, in plan views, only the top elements (2*a*, 2*b*) (FIG. 5*c*), and with respective PV arrays (50*a*, 50*b*) installed thereupon (FIG. 5*d*). The top elements (2*a*, 2*b*) present dimensions (d, e) which are, at least approximately, a divisor and/or multiple of the distance (c) between side elements (1*a*, 1*b*), and the latter is selected as a divisor and/or multiple of the total width (b). This allows disposing them, and respective PV arrays (50*a*, . . . ) (FIGS. 5*c* and 5*d*) along or orthogonal to the longitudinal direction (x). This is advantageous in view of keeping the same dominant geographic orientation of the PV arrays (50*a*, 50*b*), despite variations in the prevailing orientation of traffic infrastructure (A) along (x).

Figure 5E:
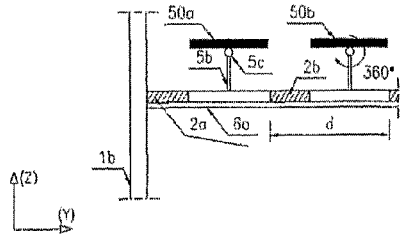
Figure 5F:
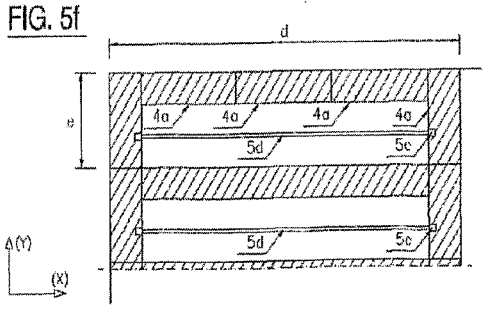

FIGS. 5*e* and 5*f* are side views of the top elements (2*a*, 2*b*) with PV arrays (50*a*, 50*b*) thereupon (FIG. 5*e*). Each PV array (50*a*, 50*b*) corresponds to a set of PV panels mounted on a common shaft (5*c*) that is pivotally mounted on a respective elevated support (5*d*), so that it may rotate by 360° on a given direction, preferably mechanically driven and automatically controlled by respective sun tracking means. This allows simultaneous orientation of several PV arrays (50*a*, 50*b*). As best seen in the plan view in FIG. 5*f*, each top element (2*a*, 2*b*) has an open construction composed of several elements (4*a*, . . . ), preferably of similar dimensions and having preferably a mesh-like construction. These elements correspond to walkways and have interlocking means so that they are assembled together along any of their edges. Two elevated supports (5*b*) are installed in opposition, each provided with pivotal mountings (5*c*) that carry the array shaft (5*d*). A layer of a very light material (6*a*) may be placed underneath the top elements (2*a*, . . . ) to protect them from ascending pollutants and particles. Material (6*a*) can have an aerodynamic configuration and present sound absorbing properties. This design significantly reduces the overall loads upon the top elements (2*a*, 2*b*).

Figure 6:
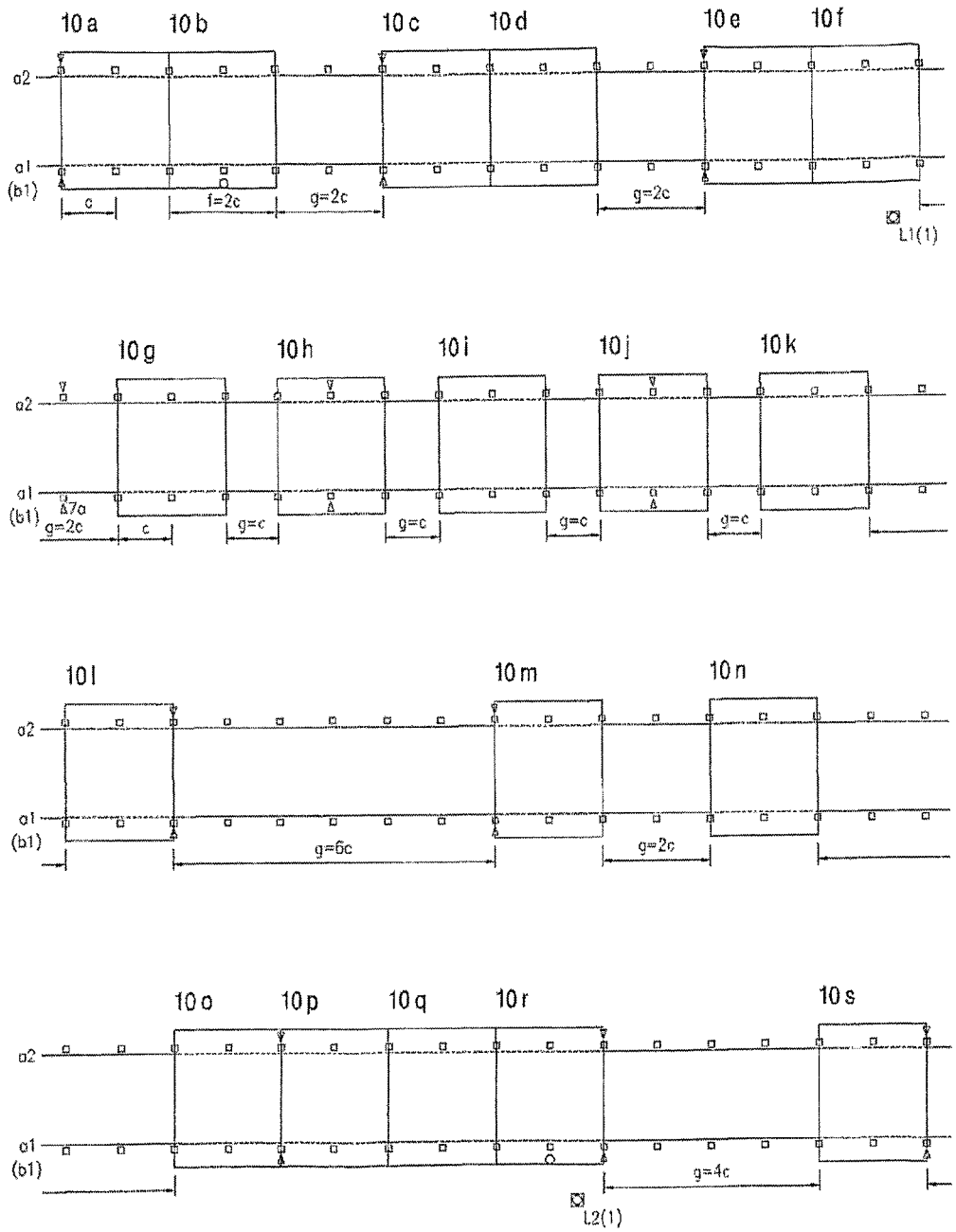
FIG. 6 illustrates a third example of a section of traffic infrastructure according to the present invention with structures according to FIG. 5, and respective management method.
Figure 9:
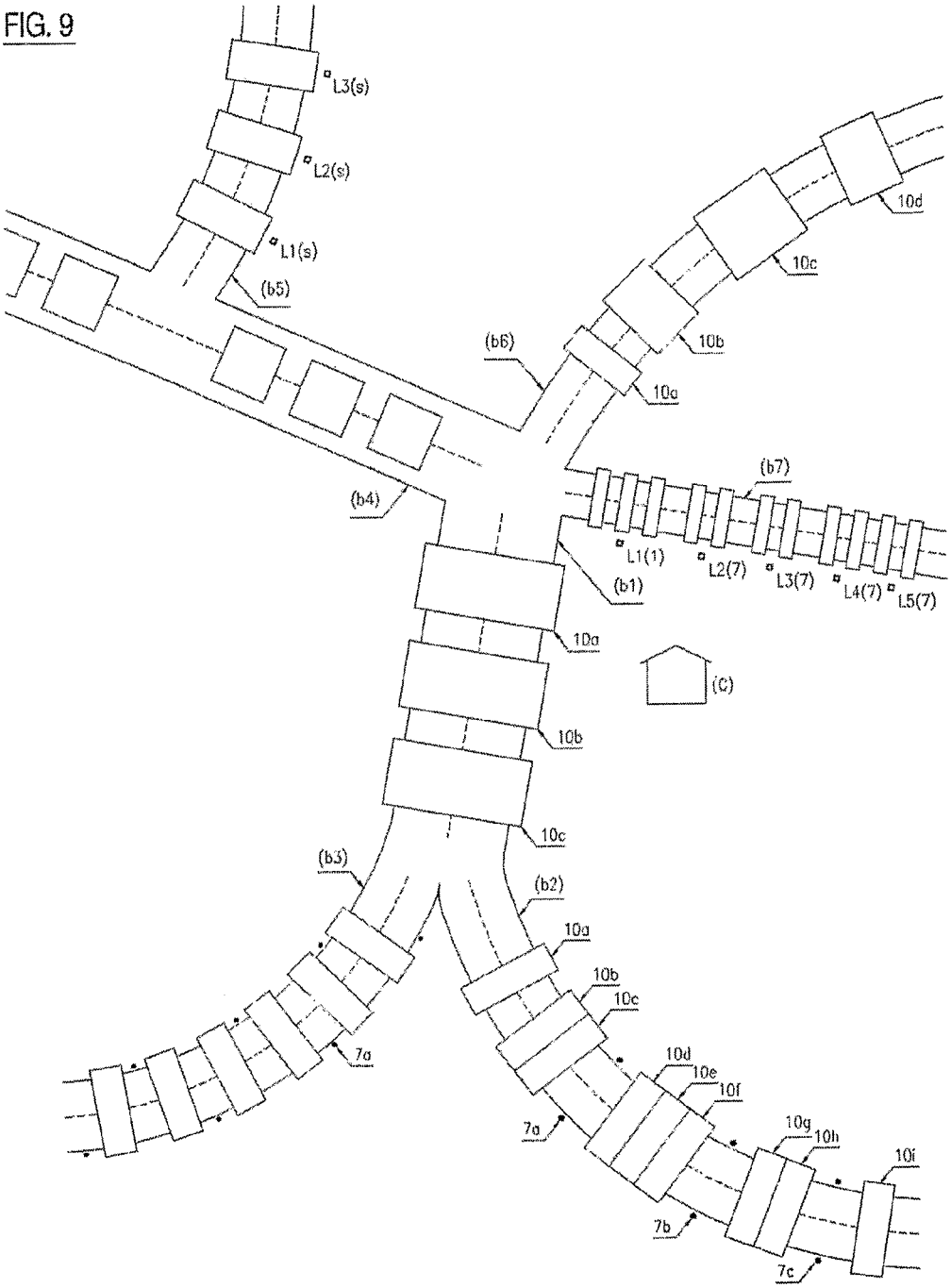
FIG. 9 illustrates a schematic, map-like representation of different sections of a traffic infrastructure according to the present invention, and a remote central station.

FIG. 6 represents a third embodiment of a traffic section (b1) according to the invention, including structures (10*a*, 10*b*) according to FIGS. 5*a*-5*f*, as well as local control stations (Ln, . . . ), identified by a box with a x inside. In this embodiment, the distribution of structures (10*a*, 10*b*) produces certain regular patterns along section (b1): in groups, as e.g. pairs (from 10*a* to 10*f*), individually (from 10*g* to 10*l*), or in "short-long" successions (10*m* to 10*s*). Another aspect is the inclusion of roadside elements (7*a*) preferably similar to some side elements (1*a*) and disposed along, preferably constant, distances (c) in the intervals between successive structures (FIG. 9). Alternatively, such elements (7*a*) may present a different configuration, such as being substantially flat at pavement level. This gives rise to a regular distribution of such elements (1*a*, 7*a*)—carrying a preferably similar lighting array (30*a*)—as identified by the small squares in FIG. 6. This allows an intensive use of such structures as traffic assistance systems, including a regular distribution of uniform active signaling/lighting, while simultaneously avoiding a "tunnel" construction.

Moreover, there are preferably several traffic flow arrays (80*a*), identified by triangles, preferably including at least one short-range sensor for sensing at least one traffic flow parameter, and short-range communication device for exchanging with array (80*a*) circulating vehicle data, disposed on at least some side elements (1*a*) of some structures (10*a*, 10*b*) and/or roadside elements (7*a*), at regular intervals along section (b1). Flow arrays (80*a*, . . . ) automatically communicate, preferably wirelessly, to a selectable number of adjacent traffic flow and/or lighting arrays (30*a*, . . . ), identified by squares, either on structures (10*a*, 10*b*) or on roadside elements (7*a*) disposed upstream and/or downstream, on one or both circulation directions. Moreover, there are several weather condition arrays (70*a*, . . . ), identified by circles, that monitor and communicate certain weather parameters, preferably at least to dedicated control systems (Sn) of PV arrays (50*a*, . . . ) and wind energy arrays (60*a*, . . . ). Should an eventual weather or traffic disturbance be identified by a respective array at a given location along section (b1), this may be signaled by the signaling/lighting arrays (30*a*) disposed along a pre-defined distance upstream and/or upstream of the occurrence. Given the preferably regular distribution of the weather condition and/or traffic flow arrays along the entire length (h) of the section (b1), a substantially continuous and autonomous traffic assistance means, a "virtual tunnel" of information is provided.

Regarding the management method, there are 3 levels for both processes: dedicated systems (Sn), local control stations (Ln), and a remote station (C) (see also FIGS. 9 and 10), that intervene according to data gathered by each. Each local control station $Ln_{(1)}$ in a section (b1) communicates with the lighting arrays (30*a*), PV arrays (50*a*, . . . ), wind energy arrays (60*a*, . . . ) and power delivery stations (Pn, . . . ), not represented in FIG. 6 for simplification reasons, installed at certain regular lengths along section (b1) to supervise their individual operation, automatically receiving and evaluating data gathered by the weather condition (70*a*) and/or traffic flow arrays (80*a*), and relaying to them certain commands resulting from processing such data. Local station $L1_{(1)}$ automatically monitors and controls structures (10*a*) to (10*l*) and all lighting arrays (30*a*, . . . ) and traffic flow arrays (80*a*) installed in-between, whereas local station $L2_{(1)}$ monitors and controls all structures from (10*m*) to (10*v*) and lighting arrays (30*a*) in-between. Moreover, each $Ln_{(1)}$ communicates with a remote station (C) that automatically monitors and evaluates certain operating parameters and, in certain conditions, either pre-defined or discretionarily decided by an operator, also relaying certain commands, either directly or via the local control stations Ln(1), to each of the renewable energy systems or traffic assistance systems in the structures (10*a*, 10*b*) or in the side elements (7*a*) along the section (b1).

Figure 7A:
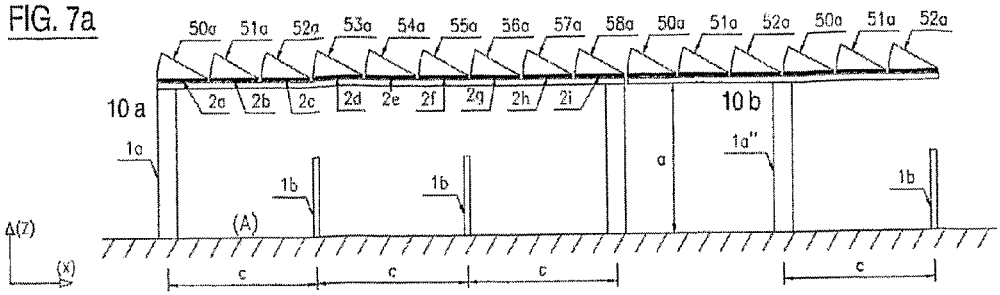
FIGS. 7*a*-7*e* illustrate a fourth preferred embodiment of multipurpose structures according to the present invention.

FIG. 7*a* is a side view of a fourth embodiment of structures (10*a*, 10*b*) according to the invention. Successive side elements (1*a*, 1*b*) alternate in irregular (1*a*) and regular (1*b*) manner along (x), disposed in preferably directly opposing, pairs across (y). Some side elements (1*b*) are preferably placed in front of side elements (1*a*). At least some successive structures (10*a*, 10*b*, . . . ) share side elements (1*a*), or have top elements (2*a*, . . . ) between them (1*a*).

Figure 7B:
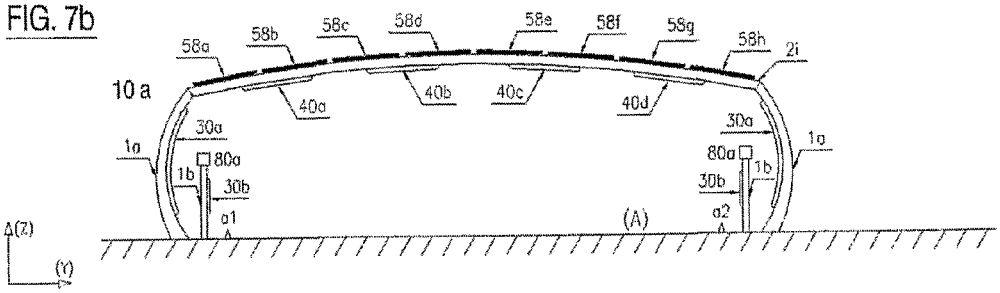

FIG. 7*b* is a front view of such structures (10) and (10*a*). Some side elements (1*a*) have a curved format and support several elongated, also slightly arched. Top elements (2*a*, 2*b*), span across traffic infrastructure (A). Other side elements (1*b*) have a linear format and much smaller height and carry at least one lighting array (30*b*) and a traffic flow array (80*a*) at a traffic circulation level. The other side elements (1*a*) also carry vertical lighting arrays (30*a*) but these substantially extend over the length of (1*a*) and are of similar configuration to those placed underneath the top elements (40*a*, 40*b*). Such spatial arrangement maximizes signaling/lighting efficiency, especially in wide traffic infrastructures such as highways.

Figure 7C:
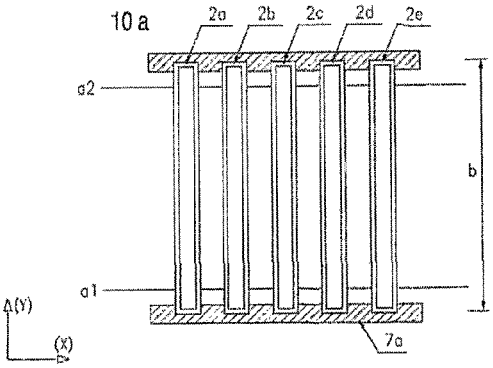
Figure 7D:
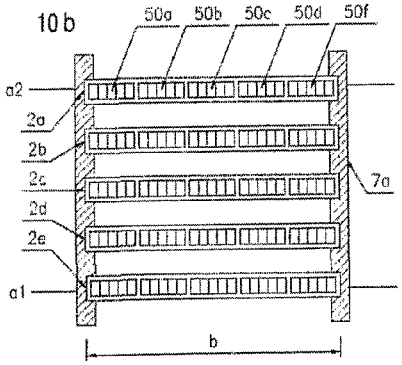
Figure 7E:
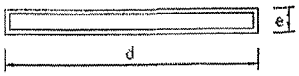

FIGS. 7*c* and 7*d* are plan views of the top elements (2*a*, 2*b*) which present a frame-like construction (FIG. 7*e*), reducing overall weight and wind-loads, and are supported at their narrower sides by flat construction elements, designed as access walkways (8*a*). Upon the top elements (2*a*, 2*b*) there are one or several PV arrays (50*a*, 51*a*) at least approximately of corresponding width (e), installed with a desired spacing in between, along the length (d), in this case equivalent to (b) (FIG. 7*d*). Moreover, the length (b) preferably corresponds to a multiple of the distance (c).

The PV arrays (50*a*, 51*a*) are based on a concentrated solar radiation technology of modular assembly, whereby the modules are eventually pre-assembled with respective integrated sun tracking means. The open construction of the top elements (2*a*, 2*b*), eventually also with aerodynamic and/or sound-absorbing area elements (6*a*) underneath, leads to enhanced air circulation and, therefore, a very advantageous enhanced heat dissipation capacity at the PV arrays (50*a*).

Figure 8:
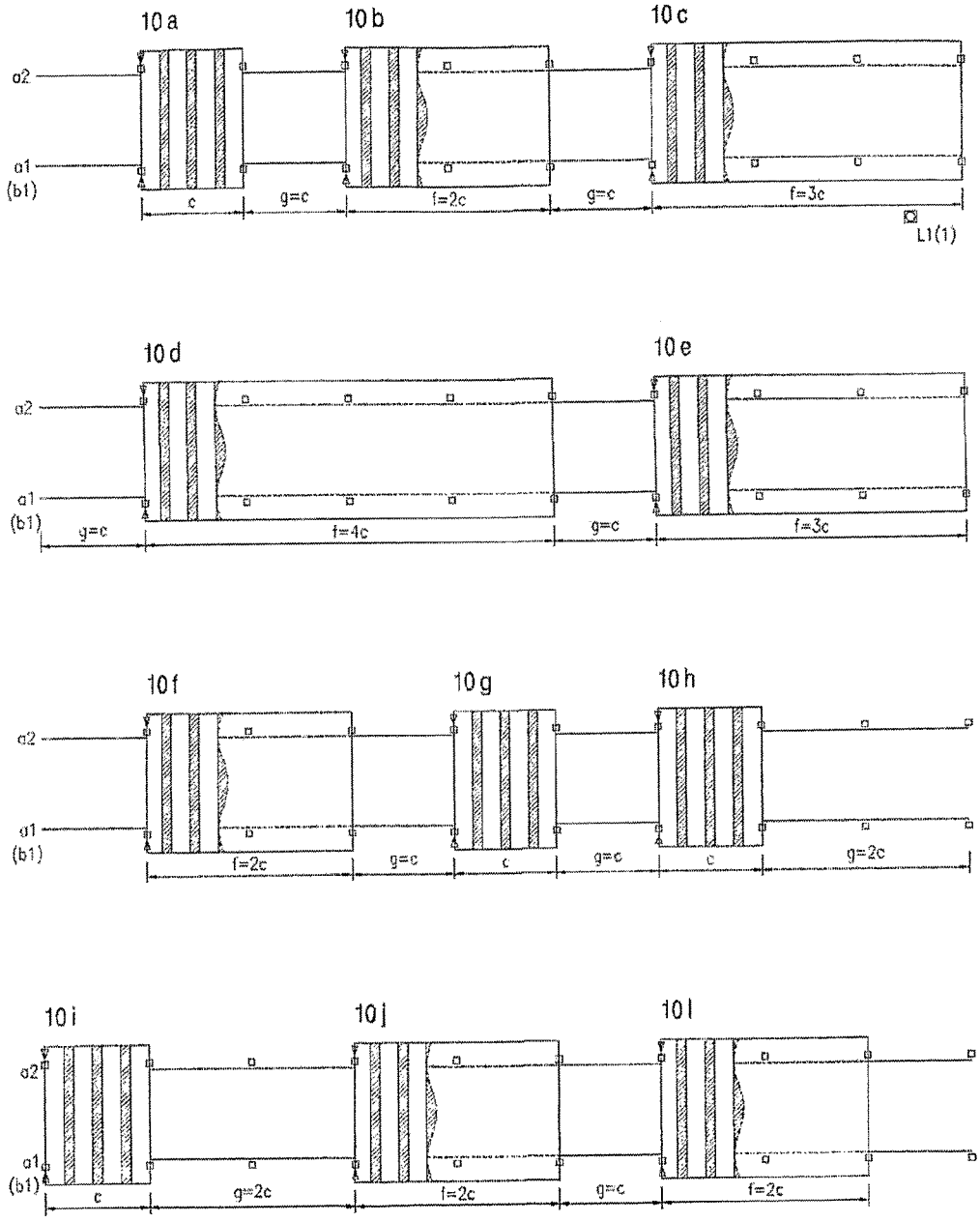
FIG. 8 illustrates a fourth example of a section of traffic infrastructure according to the present invention with structures according to FIG. 7, and respective management method.

FIG. 8 represents a fourth traffic section (b1) according to the invention, including structures (10*a*, 10*b*) according to FIGS. 7*a*-7*e*.

The configuration and distribution of structures along a traffic section (b1) are, according to the invention, themselves used as a way of optimizing light/shade patterns and wind loads upon circulating vehicles. Longer structures (10*b* to 10*f*) are in this case used along a substantially exposed plane area, whereas shorter structures (10*g* to 10*i*) are used along a less exposed, mountainous one, thereby following a linear, preferably a exponential variation of lengths (f1, . . . ) and distances (g1, . . . ) apart. The overall length (f) of structures, when individually installed or in groups of directly adjacent ones, should not exceed about 1000 m, preferably about 500 m, more preferably about 100 m.

In this case there is only one, fully centralized management level for all renewable energy systems and traffic assistance systems within a given section (b1), carried out by one local control station (Ln), or by a remote central station (C). All lighting arrays (30*a*, 40*a*), PV arrays (50*a*) and monitoring means are therefore fully controlled by a remote station (C), whereby local stations (Ln) may act only as communication means, preferably by means of fiber optics, between local monitoring means and remote central station (C). The station (C) may also use external sources, such as weather forecasting, power grid supervision, traffic video monitoring, and traffic toll collection systems, to optimize the operation of the renewable energy systems and of the traffic assistance systems installed along each section (b1, . . . ) (see FIG. 10).

FIG. 9 represents several sections (b1, . . . , b6), each including structures (10*a*, 10*b*) presenting different configurations and distribution patterns, notably according to infrastructure typology and local (urban) landscape. The distribution of power delivery stations (Pn), corresponding to individual or groups of structures, may thereby be adjusted to power demand levels of adjacent areas. Sections (b2) and (b3) also include roadside elements (7*a*), providing extended signaling/lighting. Local control stations (Ln) communicate with a remote station (C) that monitors and controls, as required, all relevant renewable energy systems and traffic assistance systems installed in such sections (b1, . . . ). In section (b5) there is one local control station (Ln) associated with each structure (10*a*, 10*b*), whereas in section (b7) each one is associated to a group of structures. Naturally, such a remote station (C) may also supervise different sections (b1, . . . ) of more than one traffic infrastructure (A).

Figure 10:
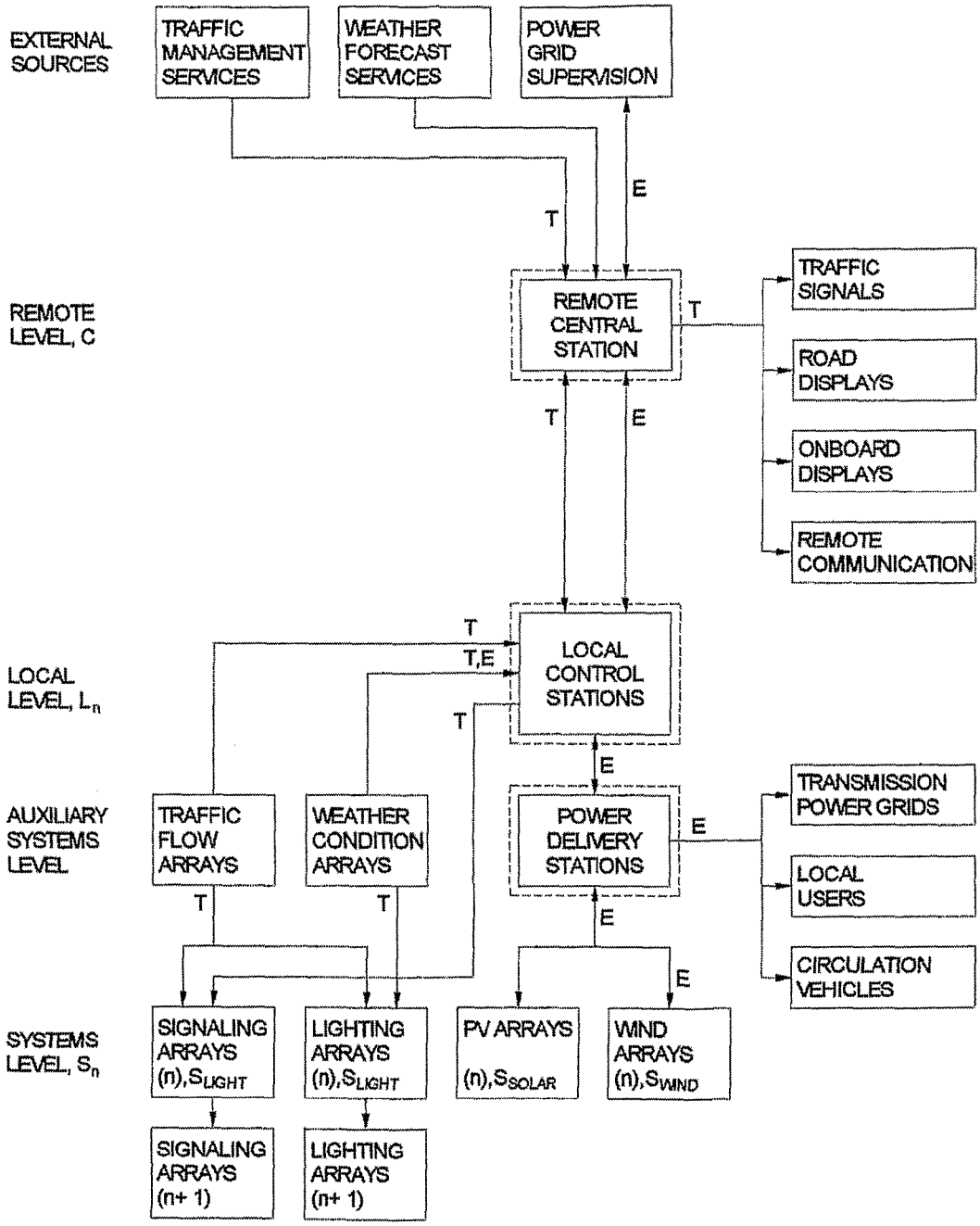
FIG. 10 illustrates a schematic representation of data sources and destinations in a management method according to the present invention.

FIG. 10 represents the general information architecture of a management method according to the present invention. There are basically two processes taking place: one (E) regarding generation, handling and distribution of power along a section (b1), and another (T) regarding monitoring, evaluation and display of traffic assistance information. These processes may unfold across several levels, according to respective embodiments thereof. As previously described, the renewable energy systems and traffic assistance systems may be controlled according to different architectures, ranging from one level, fully decentralized (only control systems, Sn level), or fully centralized (only a remote central station, C), up to three levels (control systems Sn—plus power delivery station Pn,—and local control stations Ln,—plus remote station C) plus external systems.

I claim

1. A traffic infrastructure system for combining traffic assistance and renewable energy systems comprising:

a traffic infrastructure for traveling vehicles;

a traffic circulation section extending along a length of said traffic infrastructure including a traffic circulation area adapted for the circulation of vehicles and providing assistance for vehicles traveling along said length;

a plurality of successive fixed structures installed successively along the longitudinal direction of said traffic circulation section;

said successive fixed structures including fixed side elements arranged sideways and spaced in at least one general alignment thereof along said longitudinal direction and over the length of said traffic circulation section;

at least some of said fixed side elements supporting at least one top element in at least one upper level of respective fixed structures and provided at least in part over at least part of said traffic circulation section area;

at least some of said successive fixed structures including solar energy systems and lighting arrays powered by said solar energy systems;

said top elements presenting solar energy systems;

said successive fixed structures are arranged in fragmented manner at distances (g) apart that are generally a multiple of the distance (c) between at least some of said successive fixed side elements;

said lighting arrays provided in at least one of over and sideways disposition relative to said traffic circulation section area;

said lighting arrays adapted so as to provide traffic assistance by means of at least one of lighting and active signaling;

said successive fixed structures varying in at least one of length (f) of said top elements and distances (g) apart respective fixed elements in at least one longitudinal alignment thereof, so as to adjust the visual constrain resulting from said solar energy systems in said top elements and the traffic assistance provided by said lighting arrays for vehicles traveling along said traffic circulation section.

2. The system of claim 1 wherein at least two successive structures are installed adjacent to each other thereby sharing at least one side element and forming continuous groups of said successive structures.

3. The system of claim 1 wherein the total length (f) of successive structures or groups of successive structures add up to about 20% to 90% of the total length (h) of said traffic circulation section.

4. The system of claim 1 wherein the total length (f) of successive structures or groups of successive structures add up to about 40% to 70% of the total length (h) of said at least one traffic circulation section.

5. The system of claim 3 wherein the distance (g) apart between at least two of said successive structures is defined as a function of at least one of the general topography, visibility conditions, road design, traffic typology, and maximum driving speed for a given length ahead.

6. The system of claim 5 wherein the said respective distances (g) apart of successive fixed structures, or continuous groups of successive fixed structures, follow one of a constantly regular, varying regular and random distribution along the length (h) of said at least one traffic circulation section.

7. The system of claim 6 wherein said distance (g) between two successive fixed structures, or continuous groups of fixed structures, is generally the same as one of a length ($f_1$) of a first fixed structure , a length ($f_2$) of a second fixed structure, and of a length of respective continuous groups of successive fixed structures.

8. The system of claim 1 wherein said fixed structures comprise at least two side elements disposed successively along the longitudinal direction of said traffic circulation section; at least some of said side elements carry at least one lighting array, and at least some of said side elements carry at least one top element at a height above said traffic infrastructure.

9. The system of claim 8 wherein at least one top element supports at least one PV array, and at least two consecutive said side elements are disposed at a relatively close distance from each other, as measured along one of a respective sideway and traffic dividing area of said traffic infrastructure.

10. The system of claim 1 whereby said fixed structures have a height in the range of about 4 m-20 m.

11. The system of claim 10 whereby said fixed structures have a height in the range of about 5-12 m.

12. The system of claim 11 whereby said fixed structures have a height in the range of about 6-8 m.

13. The system of claim 1 including sideways formed by a dividing area of said traffic circulation section, wherein a width of said fixed structures corresponds to at least 50% of the total width of one of said sideways.

14. The system of claim 13 where a width of said fixed structures corresponds to at least 75% of the total width between said sideways and a dividing area of said traffic section.

15. The system of claim 14 where the width of said fixed structures corresponds to at least 90% of the total width between one of said sideways and a dividing area of said traffic section.

16. The system of claim 1 wherein a distance between one of two side elements, and two consecutive side elements, is one of about 2-500 m.

17. The system of claim 16 wherein the distance between one of two side elements and two consecutive side elements, is about 5-100 m.

18. The system of claim 17 wherein a distance between one of two side elements and two consecutive side elements, is about 10-50 m.

19. The system of claim 1 including sideways formed along said traffic circulation section wherein said side elements are installed in one of sets along at least one sideway, along a dividing area, in sets of at least two disposed in direct opposition across the sideways, and a dividing area and sets of at least one disposed in alternated positions across the sideways and a dividing area.

20. The systems of claim 1 wherein said side elements are one of similar and different heights, cross-section, and overall configuration.

21. The system of claim 1 wherein at least some of said side elements have one of a telescopic array that allows raising or lowering of a top element, a knee-like support allowing their base to rotate.

22. The system of claim 1 wherein at least some of said side elements have top elements including at least one of a renewable energy system, a lighting array, a weather element, a light shading, a sound absorber, and a carbon dioxide absorber.

23. The system of claim 22 wherein said fixed structures include at least 30% of the overall area defined by said top element.

24. The system of claim 23 wherein said fixed structures include at least 50% of the overall area defined by said top elements.

25. The system of claim 23 wherein said fixed structures include at least 70% of the overall area defined by said top elements.

26. The system of claim 23 wherein said fixed structures include at least one of a top element carried on its interior side, an area element having one of a substantially convex and wing-like cross-section, a lighting array, a heating element, a sound absorber, and a carbon dioxide absorber.

27. A traffic infrastructure system for combining traffic assistance and renewable energy systems comprising:

a traffic infrastructure for traveling vehicles;

at least one traffic circulation section extending over a defined length of said traffic infrastructure;

a plurality of fixed traffic structures installed and fixed successively along the longitudinal direction of said traffic circulation section for presenting traffic information to moving vehicles;

said fixed traffic structures presenting at least one renewable energy system and at least one traffic assistance system having at least one of a passive and active signaling, a lighting array, and a traffic flow array;

said fixed traffic structures including fixed side elements spaced in said longitudinal direction of said traffic circulation section, wherein at least some of said fixed traffic structures are installed at distances apart that are generally one of a multiple and divisor of a distance between at least some of said sideways fixed side elements.

28. The system of claim 27, wherein at least some of said fixed side elements present at least one of said traffic assistance systems.

29. The system of claim 27, wherein at least some of said traffic assistance means are powered by said renewable energy system.

30. The system of claim 27 wherein said fixed traffic structures comprise traffic assistance means including a lighting assembly having at least one of a light reflecting and an active lighting device; wherein each level of lighting arrays preferably presents one of a different format, functions, and operation modes, powered by said renewable energy system.

* * * * *